United States Patent [19]

Cortese

[11] Patent Number: 4,953,704

[45] Date of Patent: Sep. 4, 1990

[54] PLASTIC TRASH BAG

[76] Inventor: Alfred J. Cortese, 5615 Redwood St., San Diego, Calif. 92105

[21] Appl. No.: 323,542

[22] Filed: Mar. 13, 1989

[51] Int. Cl.[5] ..... B65D 33/30

[52] U.S. Cl. ..... 206/493; 206/286; 206/471; 383/43; 383/71; 220/404

[58] Field of Search ..... 206/493, 286, 457, 458, 206/499, 461, 464, 471, 490, 805; 220/403, 404, 407; 383/43, 71, 37

[56] References Cited

U.S. PATENT DOCUMENTS

| | | | |
|---|---|---|---|
| 2,037,175 | 4/1936 | Northcross | 150/1 |
| 2,585,214 | 2/1952 | Belmont | 229/62 |
| 2,631,629 | 3/1953 | Lee | 383/43 X |
| 3,133,690 | 5/1964 | Lui | 383/43 X |
| 3,168,209 | 2/1965 | Brookins | 220/24 |
| 3,252,567 | 5/1966 | Baron et al. | 206/493 X |
| 3,512,338 | 5/1970 | Nestler | 220/407 X |
| 3,608,712 | 9/1971 | Savoie | 220/407 X |
| 3,977,450 | 8/1976 | Schampier | 383/43 X |
| 4,280,811 | 7/1981 | Howe, Jr. | 206/805 X |
| 4,461,030 | 7/1984 | Knudsen | 383/43 |
| 4,509,570 | 4/1985 | Eby et al. | 383/33 X |
| 4,611,350 | 9/1986 | Kaczerwaski | 383/71 |
| 4,747,701 | 5/1988 | Perkins | 220/404 X |
| 4,764,029 | 8/1988 | Abblett | 383/71 |

*Primary Examiner*—Stephen Marcus
*Assistant Examiner*—Jes F. Pascua
*Attorney, Agent, or Firm*—Andsel Group; Charles C. Logan, II; David L. Baker

[57] ABSTRACT

An improved plastic trash bag having elastic means secured to the trash bag adjacent its top edge that automatically gathers the top edge inwardly thereby closing its top end. The trash bags would be sold with multiple trash bags mounted within each other and they would be mounted on a display board having a specific configuration for mounting them thereon. When used with a trash receptacle, the top edge of the trash bag is stretched to open its top end and its top edge is folded downwardly over the top edge of the trash receptacle to prevent the trash bag from slipping down into the trash receptacle.

3 Claims, 2 Drawing Sheets

PLASTIC TRASH BAG

BACKGROUND OF THE INVENTION

The invention relates to trash bags and more specifically to an improved trash bag that has structure for securing the top edge to the open top end of a trash receptacle.

Trash is a national by-product of every day business, homes, institutions, schools, and etc. As a society, we use more and more disposable items and each item is wrapped within an outer wrapper. All of this is disposable and it is discarded daily.

In most businesses the trash is dry, that is, simply paper products. The custodial business, with professional janitors, is a highly competitive business where saving material and especially time is critical to a profitably run business. The use of trash can liners has grown rapidly and is commonplace today.

The time taken to place a trash can liner into a receptacle is considerable when looking at an office complex. In the home setting, a housewife can spend extra time pulling garbage from a container if the trash liner slipped down. Further, the trash container will need cleaning when the liner walls become soiled simply because the protective liner has slipped from position.

It is an object of the invention to provide a novel improved plastic trash bag that is easily installed and removed from trash receptacles.

It is another object of the invention to provide an improved plastic trash bag that is economical to manufacture and market.

It is a further object of the invention to provide a novel improved plastic trash bag in combination with a display board which allows it to be hung on a hook.

It is also an object of the invention to provide a novel improved plastic trash bag that will eliminate the problem of the trash bag slipping down inside of the trash receptacle.

SUMMARY OF THE INVENTION

Applicant's improved trash bag has elastic structure at the upper most open end thereof. Trash bags come in various sizes to accommodate different sizes of trash receptacles. With applicant's novel trash bag, only a few sizes would be needed, principally due to the volume variations, as the elastic band will enable applicant's trash bag to fit any configuration of trash receptacle.

The trash bags have an elastic stretch band forming the upper perimeter. The trash bags are packaged on a display board that can be made of plastic or chipboard material. The display board has a hole centrally located for sales display and for later user storage ability. The display board has relieved portions located adjacent its top end that form a neck. The purpose of the neck is to provide a non-slip retaining area for the elastic stretch band material. When ready for sale or use there would be several trash bag liners stretched over each other on the display board. The user would simply pull off one trash bag at a time as required leaving the unused bags in ready position.

The purpose of the invention is to eliminate the common occurence of trash bag liners slipping into the trash receptacle itself. Trash bags, because they are not secured at the top perimeter, will frequently slip into the trash receptacle and instantly lose their value as a liner. By securing applicant's trash bag to the upper rim of the trash receptacle, it is always in the proper open position to receive trash and protect the inner walls of the receptacle.

A second purpose of the instant invention is to provide a closing means for the mouth of the filled trash bag. When trash bags of the invention are removed from the container, they will automatically close tightly securing the rubbish inside and thereby preventing spillage.

Housewives will welcome the invention as a solution to a problem of soiled trash can receptacles. Professional janitors will become more efficient as the time taken to empty an office waste basket will be less. Dumping the individual lined waste basket will be faster when the liner does not come out with the trash. The waste basket will be ready for the next day's use. Should the liner itself need be replaced, due to moisture or cigarette ashes, the janitor need only to remove the elastic structure from the top of the receptacle. Once removed, the elastic will close the mouth of the trash bag and hold the contents securely within. Spillage will be reduced or eliminated and replacement with a clean unit is fast and efficient.

There is, therefore, a need for an improvement to a common trash bag which will allow fast insertion, sure retention once installed and a means of sealing the bag against spillage upon removal. Applicant's novel improved trash bag provides such a structure and dispenses from a convenient display board.

DESCRIPTION OF THE PREFERRED EMBODIMENT

Figure 1:
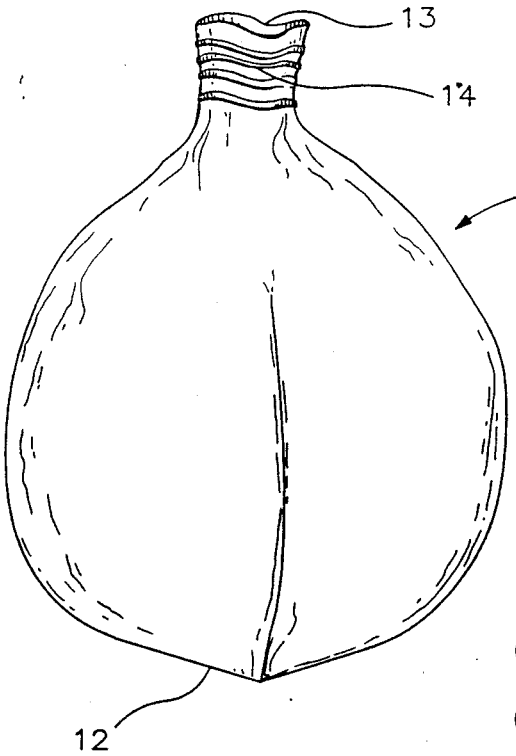
FIG. 1 is a front perspective view of applicant's novel improved plastic trash bag showing it full of trash and ready for disposable.

Applicant's novel improved plastic trash bag will now be described by referring to FIGS. 1–10 of the drawings. The trash bag is generally designated numeral 10. It has a closed bottom end 12 and a normally open top end 13. Elastic retaining structure 14 is secured to the top end of trash bag 10.

Figure 3:
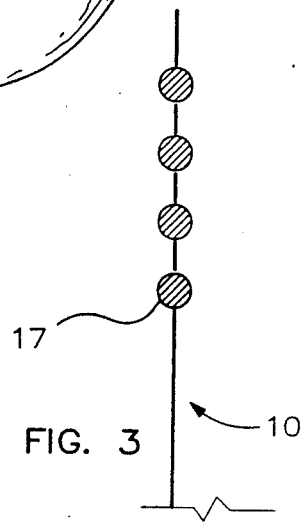
FIG. 3 is a cross sectional view along lines 3—3 of FIG. 2.
Figure 2:
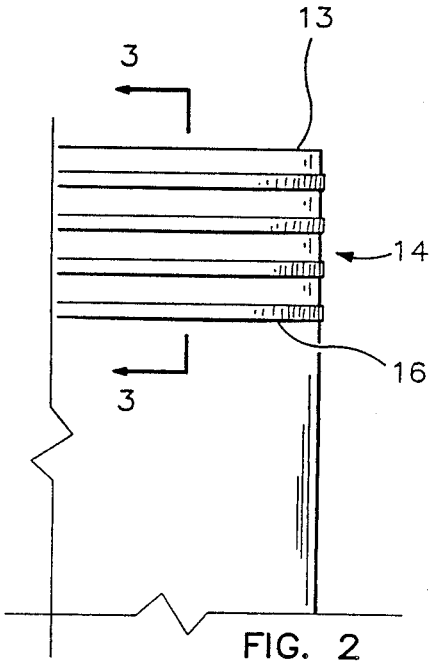
FIG. 2 is a partial side elevation view of the top area of the trash bag with a first type of elastic retaining structure.

In FIGS. 2 and 3, the specific elastic retaining structure 14 is illustrated. A plurality of elongated elastic cords or strings 16 are captured by a strip of material 17 that is applied to the top edge of the trash bag 10 by a heat process.

Figure 5:
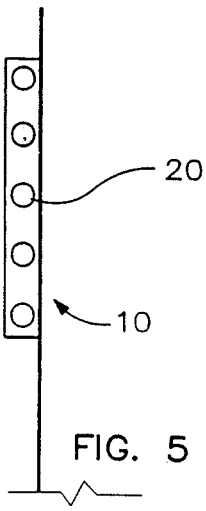
FIG. 5 is a cross sectional view taken along lines 5—5 of FIG. 4.
Figure 4:
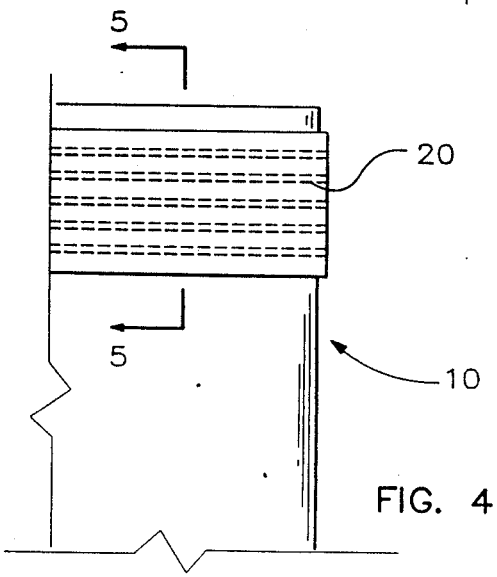
FIG. 4 is a partial side elevation view of the top portion of the trash bag illustrating an alternative elastic retaining structure.

A first alternative elastic retaining structure is illustrated in FIGS. 4 and 5. It shows an elastic ribbon 20 that has an adhesive on its inner surface secured to the outer surface of the trash bag adjacent its top end.

Figure 6:
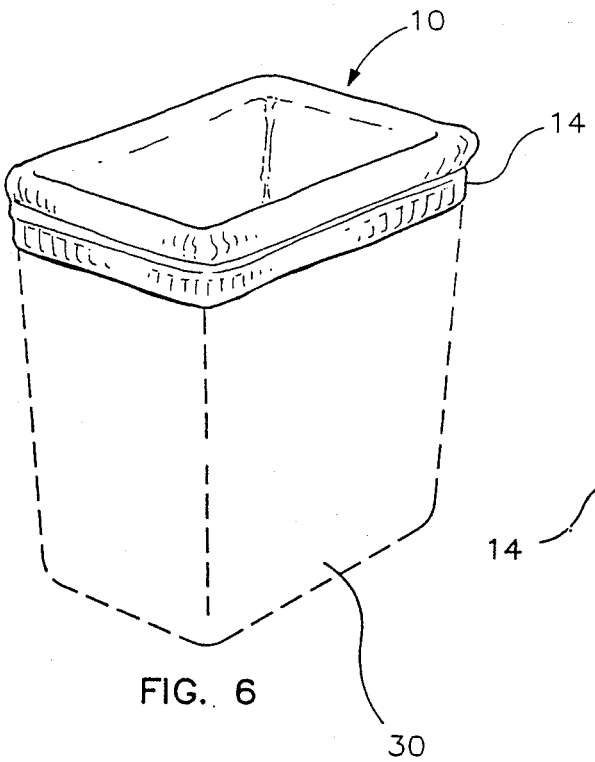
FIG. 6 is a front perspective view illustrating the novel trash bag installed on the rectangularly shaped trash receptacle.
Figure 7:
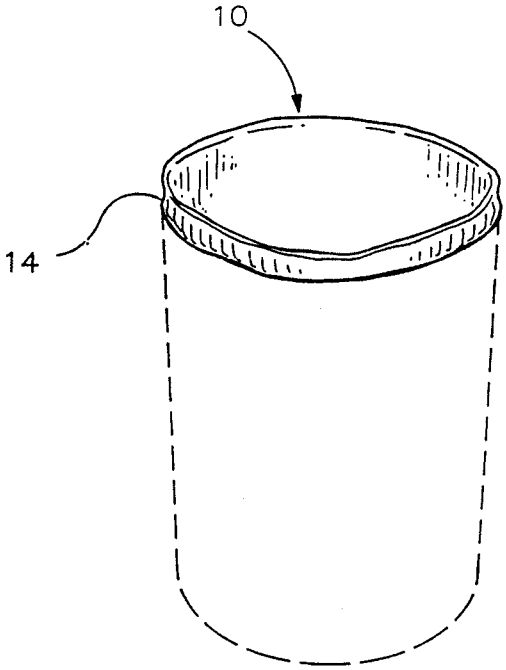
FIG. 7 is a front perspective view of the novel trash bag installed on a round trash receptacle.

In FIGS. 6 and 7 the improved trash bag 10 is shown installed on different shaped receptacles 30 and 40. The top edge of the trash bag is folded downwardly out over the outer surface of the top edge of the receptacle and the elastic retaining structure 14 secures the bag firmly in position.

Figure 9:
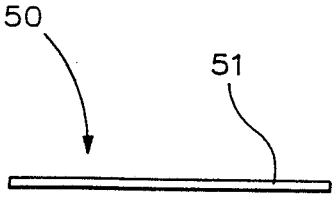
FIG. 9 is the top plan view of the display board.
Figure 8:
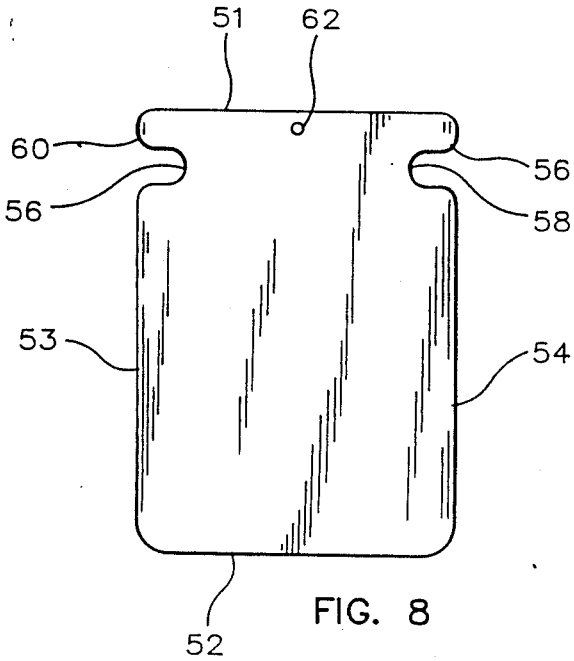
FIG. 8 is a front elevation view of the display board.
Figure 10:
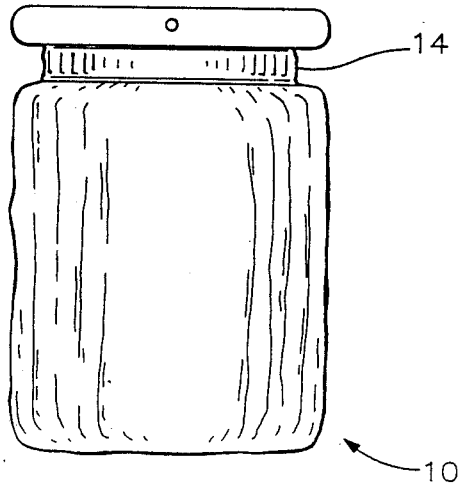
FIG. 10 is a front elevation view of the display board showing the novel trash bag packaged thereon.

A trash bag display board 50 is illustrated in FIGS. 8 and 9. It has a top edge 51, a bottom edge 52, laterally spaced side edges 53 and 54. Relieved portions 56 are formed adjacent the top end of display board 50 and they form a neck 58 and a collar 60. An aperture 62 is formed adjacent top edge 51 for hanging the display board. As seen in FIG. 10, one or more of the plastic plastic bags 10 are mounted on display board 50 and the elastic retaining structure 14 gathers the top edge of the bags into the neck portion 58 and holds them firmly in place.

The drawings as shown and thusly described represent the preferred embodiment of the invention. It would be obvious to one skilled in the art that various changes and modifications, simple or complex, could be made to the preferred embodiment which would alter the appearance but not the scope, spirit and intention of the invention. It is the intention of the inventor to preclude the occurence of such emulations in scope, spirit or design through the following claims.

What is claimed is:

1. An improved trash bag comprising:

a trash bag formed from thin sheet plastic material, said trash bag having a closed bottom end, lateral side walls, and an open top end that defines a top edge;

elastic means secured to said trash bag adjacent its top edge that automatically gathers said top edge inwardly thereby closing its top end, said elastic means being easily stretched to open the top end of said trash bag to provide access to its interior; and said trash bag being mounted on a display board formed of a planar sheet of material having a top edge, laterally spaced side edges and a bottom edge, an aperture is formed adjacent said top edge for hanging said display board, said display board being inserted into the interior of said trash bag and its elastic means gripping the side edges of said display board adjacent its top end to hold it thereon.

2. An improved trash bag as recited in claim 1 wherein said elastic means comprises a plurality of elastic cords that pass horizontally around the circumference of said trash bag, said elastic cords being vertically spaced from each other.

3. An improved trash bag as recited in claim 1 wherein said elastic means comprises a strip of elastic ribbon that passes horizontally around the circumference of said trash bag.

* * * * *